US006982547B2

(12) United States Patent
Haas

(10) Patent No.: US 6,982,547 B2
(45) Date of Patent: Jan. 3, 2006

(54) POWER FACTOR CONTROLLED REGULATOR WITH VARIABLE OUTPUT VOLTAGE FEEDBACK

(76) Inventor: Richard Haas, 10555 Fellar Cove, San Diego, CA (US) 92126

( * ) Notice: Subject to any disclaimer, the term of this patent is extended or adjusted under 35 U.S.C. 154(b) by 0 days.

(21) Appl. No.: 10/735,337

(22) Filed: Dec. 12, 2003

(65) Prior Publication Data

US 2004/0124820 A1 Jul. 1, 2004

Related U.S. Application Data

(63) Continuation-in-part of application No. 10/199,646, filed on Jul. 20, 2002, now Pat. No. 6,664,769.

(51) Int. Cl.
*G05F 1/70* (2006.01)

(52) U.S. Cl. ..... 323/207

(58) Field of Classification Search ..... 323/207, 323/282, 283, 208

See application file for complete search history.

(56) References Cited

U.S. PATENT DOCUMENTS 5,495,164 A * 2/1996 Heng ..... 323/222
5,619,405 A * 4/1997 Kammiller et al. ..... 363/80

* cited by examiner

*Primary Examiner*—Shawn Riley
(74) *Attorney, Agent, or Firm*—LaValle D. Ptak

(57) ABSTRACT

Active power factor correction (PFC) circuits are used to minimize unwanted harmonic distortion in applications where AC electrical power is rectified to produce DC power needed for operating electrical equipment. A variable amplitude regulator (VAR) is a PFC control interface which is simpler to implement than conventional circuits, and offers a wider dynamic operating range. The VAR functions as a resistor scaling network using a two-stage RC filter to maintain the DC output voltage constant for various load conditions and to maintain the rectified current in phase with the sinusoidal circuit flow in an AC power line, through both slow and rapid changes in the load coupled to the direct current output. This control interface offers excellent performance characteristics and requires only a few components for a useful implementation.

4 Claims, 4 Drawing Sheets

POWER FACTOR CONTROLLED REGULATOR WITH VARIABLE OUTPUT VOLTAGE FEEDBACK

RELATED APPLICATION

This application is a continuation-in-part of application Ser. No. 10/199,646 filed on Jul. 20, 2002 now U.S. Pat. No. 6,664,769.

BACKGROUND

Power Factor Correction (PFC) circuits are used to minimize unwanted disturbances in AC power lines, and to provide a constant DC output voltage under all load conditions. The AC line disturbances are caused by normal operation of DC powered electrical equipment, and are exhibited as phase shift of the AC input current and distortion of the current waveform. The PFC minimizes the distortion and corrects the phase shift. Existing PFC control circuits are complex, difficult and time consuming to implement, and have a limited dynamic range. By incorporating a power factor correction circuit between the alternating current supply and the direct current supply connected to the load, however, harmonic distortion in the AC power line is reduced; and the operational characteristics of some electrical equipment is improved. It is desirable to provide an improved PFC control circuit which is simple, has a wide dynamic range and requires minimal expertise to implement using a variable Amplitude Regulator (VAR) to accomplish this by using simple resistive scaling, instead of complex multiply and divide circuit functions, to produce the PFC control signal.

SUMMARY OF THE INVENTION

It is an object of this invention to provide an improved power factor correction (PFC) system.

It is another object of this invention to provide an improved variable amplitude regulator (VAR) signal interface in a switch-mode PFC system.

It is an additional object of this invention to provide an improved analog variable amplitude voltage regulator for use in a power factor correction system.

It is a further object of this invention to provide an improved variable amplitude voltage regulator (VAR) for use in a power factor correction system in which the VAR interface functions as a resistor scaling network utilizing at least one variable resistor for responding to a wide dynamic range of load variations.

In accordance with a preferred embodiment of the invention, a variable amplitude voltage regulator (VAR) utilized in a power factor correction system operates as a resistor scaling network. The network consists of at least one variable resistor. A source of rectified alternating current input voltage (ACR) is coupled to the resistor scaling network. The output of a voltage error differential amplifier (VES) is coupled through a filter to a digital signal processor (DSP) which converts the VES voltage into a proportional duty ratio (DR) signal. The signal then controls the resistance value of the variable resistor such that the scaling network produces a demand level control signal (DLS) for the power factor correction circuit.

DETAILED DESCRIPTION

Figure 1:
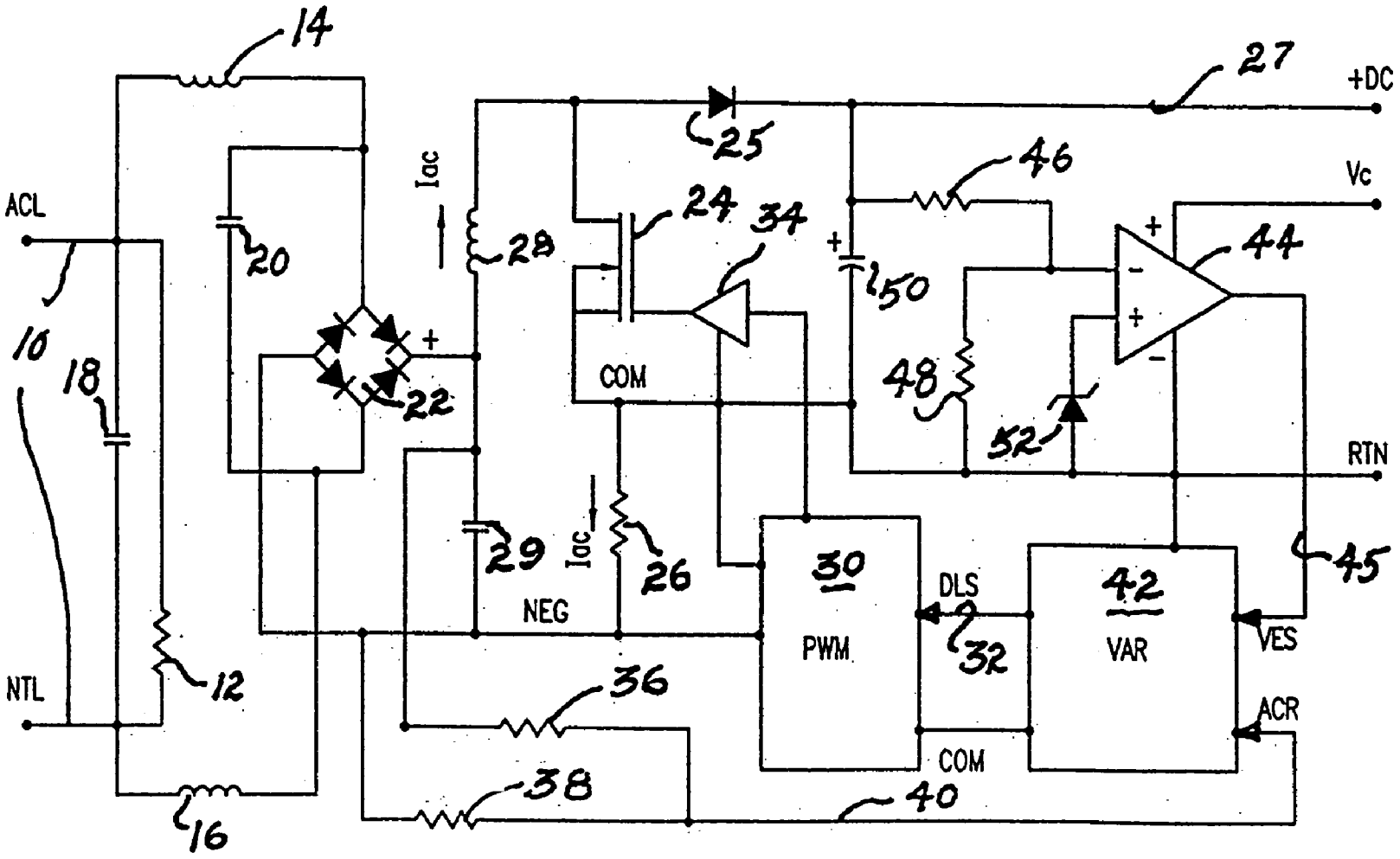
FIG. 1 is a schematic diagram of a power factor correction circuit incorporating a preferred embodiment of the invention.

Reference now should be made to the drawings, in which the same reference numbers are used throughout the different figures to designate the same or similar components. FIG. 1 is a schematic diagram of a switch-mode boost converter of a typical configuration, which is used for a power factor correction circuit. In the circuit of FIG. 1, the location and functional interconnections of a variable amplitude regulator interface (VAR) are illustrated.

In the circuit shown in FIG. 1, standard alternating current (AC) utility power is connected across the input terminals 10, also designated as ACL-NTL. Although a specific implementation of a switch-mode boost converter is illustrated in FIG. 1, other implementations may be used. The alternating current input voltage is filtered by a common mode choke consisting of a pair of independent windings 14, 16 and a pair of capacitors 18 and 20 interconnected in a conventional manner across the AC input line 10. This filtered alternating current voltage is applied to a full wave bridge rectifier 22. The rectifier 22 output is connected to a switch-mode boost stage consisting of an inductor 28, a capacitor 29, a transistor (MOSFET) 24 and a resistor 26. The capacitor 29 is connected across the DC terminals of the rectifier 22; and the positive terminal of the rectifier 22 is connected through the inductor 28 and an additional diode 25 to the positive DC output load terminal 27. The negative or return terminal of the rectifier 22 is coupled to the lower side of the resistor 26, shown in FIG. 1. A large electrolytic capacitor 50 is placed across the DC output terminals to smooth the output voltage and current.

In order to achieve the desired sinusoidal current flow in the AC power line (see FIG. 2, top set of waveforms), it is necessary to regulate the current flow through the power inductor 28 in the switch-mode boost stage. At any instant in time, the magnitude of the current in the inductor 28 is equal to the absolute value of the alternating line current. This is indicated by the designation Iac in FIG. 1. As is apparent from FIG. 1, this same current flows through the transistor 24 and the resistor 26, which are connected in series with the inductor 28 across the terminals of the rectifier 22. Regulation of this current through the inductor 28 and the resistor 26 is controlled by a pulse width modulation circuit (PWM) 30, used to adjust the on/off duty ratio of the MOSFET transistor 24.

The functional characteristics of pulse width modulation circuits, such as the circuit 30, are well understood and a detailed description of the operation of such a circuit is not considered necessary here. The PWM circuit 30 shown in FIG. 1 uses an average current-mode control method to regulate the current through the inductor 28, as a function of the Iac feedback current from the resistor 26 and of a demand level signal (DLS) 32 provided by a PFC control circuit. The output of the PWM circuit 30 connects through a driver 34 to the gate of the MOS FET 24 to modulate its on/off duty ratio in order to control current flow through the inductor.

Required inputs to the PFC control circuit are the AC rectified voltage signal (ACR) and the voltage error signal (VES). The ACR is generated through the resistor divider 36 and 38, and the VES is the output of the differential amplifier 44 on the lead 45. The PFC circuit causes the current waveform in the power inductor 28 to be congruent and in phase with the AC voltage waveform. It also responds to changes in load by adjusting the amplitude of the AC input current. In this new PFC circuit implementation which is illustrated in FIG. 1, the control functions needed for power factor corrections are provided by the VAR interface.

Figure 2:
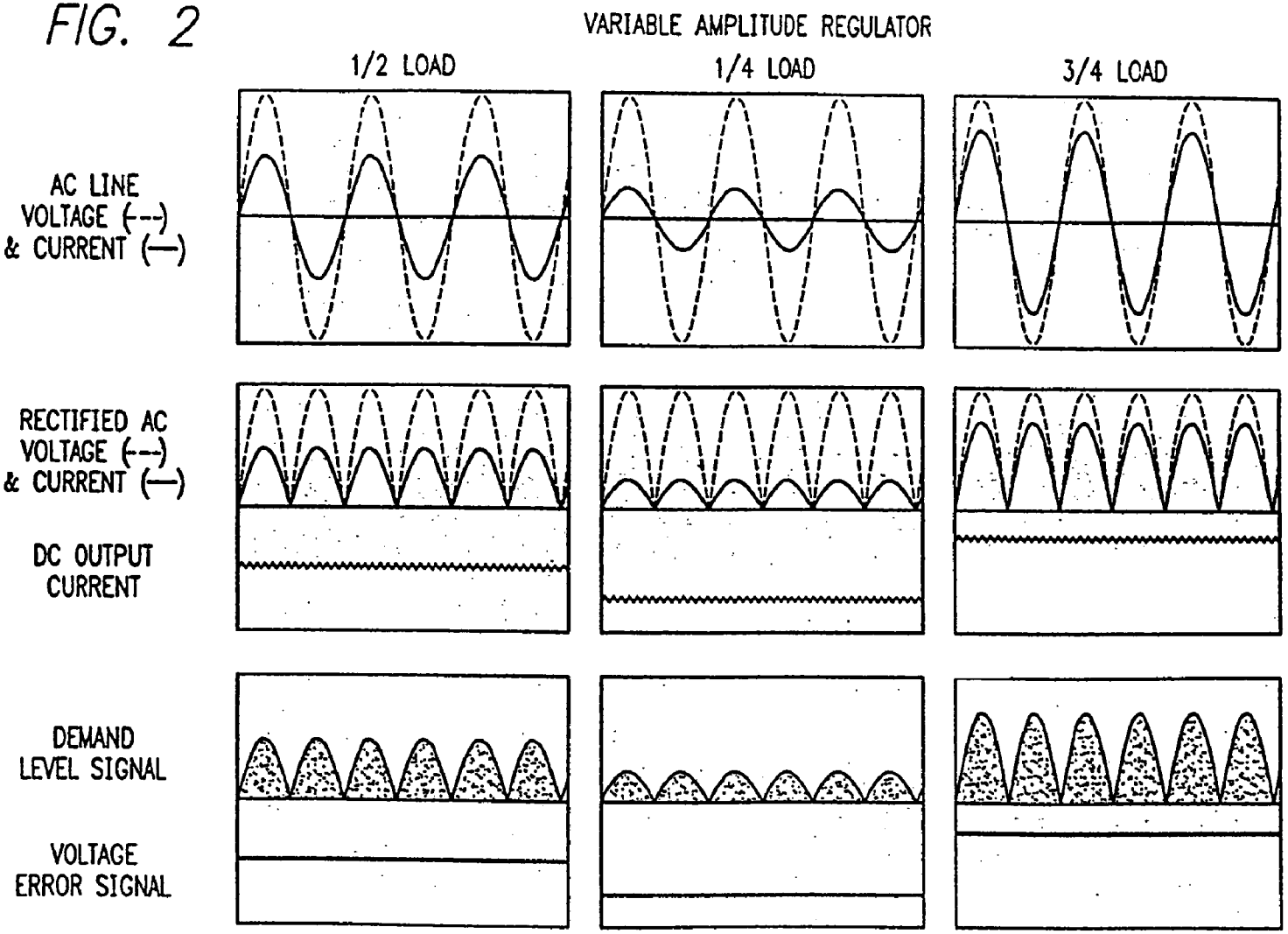
FIG. 2 illustrates waveforms useful in understanding the operation of the system shown in FIG. 1.

The VAR interface causes the waveform of the current in the power inductor 28 to be congruent and in phase with the rectified AC input voltage (ACR), as indicated in FIG. 2. At the same time, the Iac RMS value must be regulated to maintain the DC output voltage for various changing load conditions. Load variations are detected by a voltage error differential amplifier 44, which produces a voltage error signal VES on the line 45. This signal is produced by comparing the output DC voltage on the load terminal 27, as it appears across a resistor divider consisting of the a resistor 46 and the resistor 48 coupled to one input of the amplifier 44 against a fixed reference provided across the Zener diode 52 connected to the other input of the amplifier 44. The filter capacitor 50 also is connected across the DC output, as is readily apparent from FIG. 1.

Whenever changes occur in the direct current load connected across the positive direct current terminal 27 and the negative or return (RTN) terminal shown in FIG. 1, a corresponding change or variation occurs in the output of the amplifier 44 in the VES signal applied over the line 45. The VES control signal on the line 45 is supplied as one of two inputs to the variable amplitude regulator interface circuit (VAR) 42. The other input is the rectified AC voltage (ACR) obtained from a voltage divider consisting of the resistors 36 and 38 connected across the output terminals 18 of the rectifier 22. The two signals are combined to produce the control signal DLS for operating 19 the pulse width modulator 30, which in turn controls the conductivity of the FET transistor 24 for regulating the current flow through the power inductor 28, as described above.

As mentioned previously, in a power factor correction (PFC) application, it is desirable to change the RMS value of the current, but not the wave shape, to prevent harmonic distortion of the alternating input current applied at the terminal 10. Consequently, whenever the load connected to the terminal 27 changes, the system must both regulate the wave shape of the incoming alternating current signal on the terminals 10, as well as the changes in the DC load current, without much delay. By employing the VAR interface 42, which can respond to both slow changes of the DC load as well as stepped changes or rapid changes, the switch-mode modulator 30, which controls the operation of the transistor 24, is allowed to run at frequencies as low as 25 Khz, in contrast to systems of the prior art which typically had a 80 Khz lower limit.

The VAR interface produces a single output, the demand level signal (DLS), which is used as a control input by the PWM in the power stage of the PFC. This single output serves two functions, correction of the AC current waveform and phase, and adjustment of the AC current amplitude in response to changes in load.

There are two inputs to the VAR interface, the AC rectified voltage (ACR), and the voltage error signal (VES). The ACR is the output of the bridge rectifier 22 through the resistor divider 36 and 38, and is used to control the waveform and phase of the AC input current. The VES is the output of the differential amplifier 44, and is used to control the average value of the AC input current.

The VAR interface design is based on a simple concept using a variable resistor ratio to control the amplitude of the signal (acrx) derived from the rectified AC input voltage (ACR). This control arrangement is illustrated in a simplified circuit diagram shown in FIG. 3. The relationship between the ACR and the DLS is defined by the following equation $$DLS = \left(\frac{R2}{R1 + R2}\right) \times \left(1 + \frac{R4}{R3}\right) \times ACR$$

In a typical application, the VES is connected to the terminal 45 to control the variable resistor 64. A resistor 80 and a capacitor 82 form a low pass filter to block AC line frequency ripple, from causing harmonic distortion. A resistor divider consisting of a resistor 62 (R1) and a variable resistor 64 (R2) produce a reduced ACR voltage which is connected to the (+) input of a differential amplifier 68. The amplifier 68 is used as an impedance buffer and a fixed gain stage as determined by the values of resistors 70 (R3) and 72 (R4). The output of the amplifier 68 connects to the terminal 32, the demand level signal (DLS). Based on the circuit configuration shown in FIG. 3, it is obvious that a change in the resistance of variable resistor 64 (R2) produces a proportional change in the demand level signal (DLS). The voltage error signal 45 (VES) controls the value of the variable resistor 64 (R2), which in turn controls the input of the amplifier 68. The output of the amplifier 68 is the demand level signal (DLS) on terminal or line 32. The circuit of FIG. 3 also includes a feedback resistor 72 and a filter capacitor 74, interconnected in a conventional manner.

Figure 3:
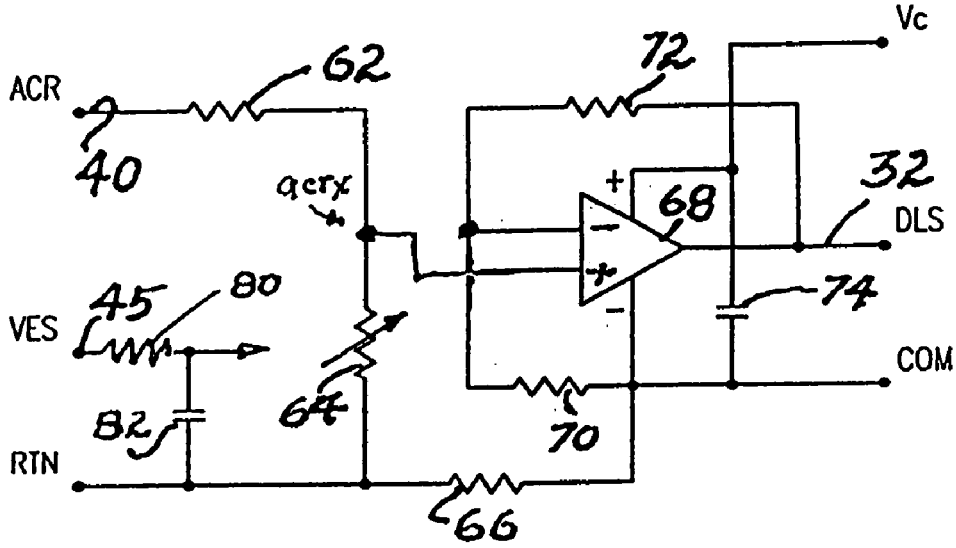
FIG. 3 is a simplified schematic diagram of a resistor scaling network useful in explaining the operation of the preferred embodiments of the invention.

In the simplified circuit of FIG. 3, it is apparent that the VAR interface which is illustrated produces a demand level signal (DLS) on the line 32, which satisfies both of the desired control functions of regulating the RMS value and maintaining the sinusoidal waveform in the current of the inductor 28. This is accomplished by combining the two input signals ACR and VES on the terminals 40 and 45, respectively. Because the value of the resistor 64 may be varied, the value of the DLS output on the line 32 is variable. By dynamically controlling the resistivity of the resistor R2, the variation in the DLS signal on the line 32 effectively may be utilized to control the PWM 30 of FIG. 1 to maintain the output voltage steady as the load changes, and to keep the input current in phase and congruent with the AC line voltage applied across the terminals 10.

Figure 4:
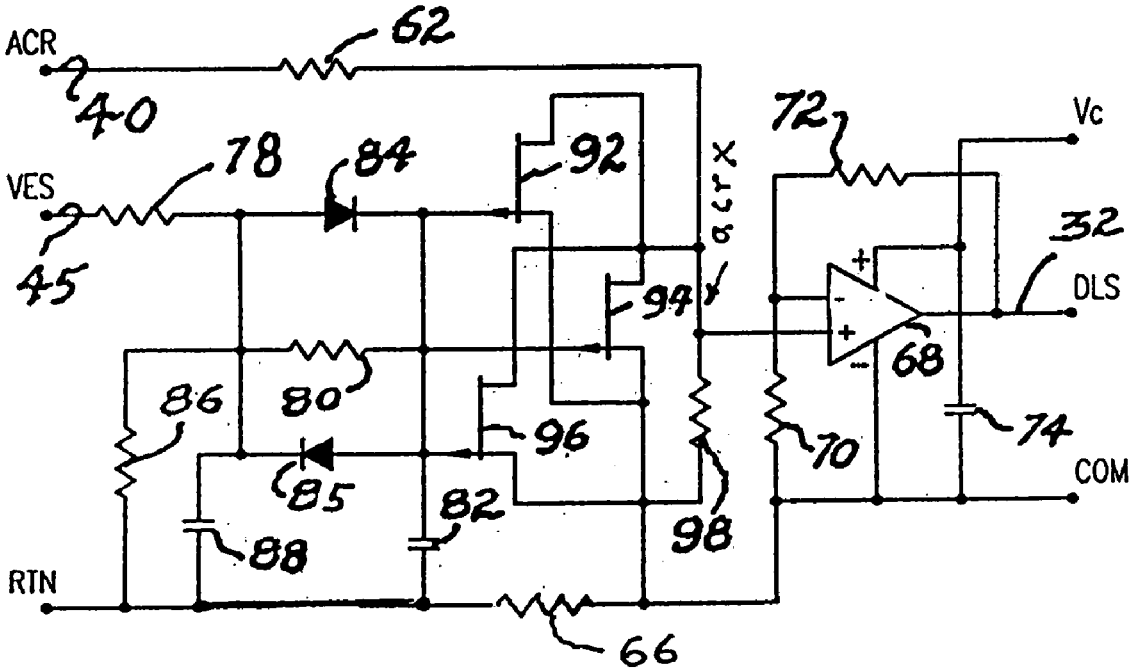
FIG. 4 is a detailed schematic diagram of an embodiment of the invention.

Reference now should be made to FIG. 4, which is a detailed schematic diagram of the VAR circuit 42 of a preferred embodiment of the invention. The circuit of FIG. 4 is the specific implementation of an actual configuration of the resistor scaling network described generally in conjunction with FIG. 3.

In the circuit of FIG. 4, the ACR signal is applied on the terminal 40; and the VES signal is applied on the lead 45, as in the case of the circuit of FIG. 3. The input return signal is shown at the bottom of FIG. 4 as RTN. The output differential amplifier 68 is illustrated providing the DLS output on the line 32, and is shown with the feedback resistor 72 connected in series with the resistor 70 to provide gain to the differential amplifier 68. The input obtained from the scaling circuit is supplied to the +terminal of the amplifier 68.

As shown in FIG. 4, the ACR signal on terminal 40 connects through the resistor 62 to the drains of three identical JFETs 92, 94, and 96. These JFET devices are connected in parallel with each other and function as a voltage controlled variable resistance. Many different field effect transistor (FET) types are available and can be used; however, the VAR circuit schematic illustrated in FIG. 4 is designed to incorporate a type J175. The voltage error signal (VES) applied at terminal 45 provides the control for regulating the resistance of the three JFETs, 92, 94 and 96. The frequency response of the VAR interface is tailored to accommodate three basic requirements: low harmonic distortion, fast reaction to sudden changes in AC input voltage, and fast reaction to sudden changes in DC output (load) current.

In order to achieve low harmonic distortion and a power factor of 0.99 or better, it is necessary to insert a low pass filter between the VES terminal 45 and the gates of the three JFET devices 92, 94 and 96. This filter is necessary to block the AC line frequency ripple, which is superimposed on the voltage error signal (VES). The AC line frequency ripple occurs in PFC circuits because the AC input current is cyclical and the DC current is nearly constant during steady state operation. In this implementation, the filter consists of a network of seven components, namely resistors 78, 80 and 86; capacitors 82 and 88; and diodes 84 and 85. The selection of each component is based on specific functional requirements. Resistors 78 and 86, and capacitor 88 are chosen to form a high frequency attenuator which reduces switching noise in the VAR interface. Resistor 80 and capacitor 82 form a low pass filter to block the AC line frequency ripple to achieve low harmonic distortion.

The gates of the transistors 92, 94 and 96 are connected in common to a filter network which includes resistors 78 and 86 and a capacitor 88 connected between the VES input terminal 45 and RTN. A resistor 80, having a high value of resistance (typically on the order of 100 k Ohm), in conjunction with a capacitor 82, operates as an input filter having an RC time constant which preferably is 100 ms or longer than the time constant provided by the filter including the resistor 86 and the capacitor 88. This time constant assures a very constant gate control voltage on the gates of the JFETS 92, 94 and 96 for steady state or slow variations of the control signal VES on the terminal 45.

To provide a faster response during step load or rapid load changes, a pair of opposite conductivity diodes 84 and. 85 are connected in parallel to bypass the resistor 80. The forward voltage drop of these diodes is approximately 0.6 Volts; so that VES level changes on the terminal 45 of 0.6 Volts or greater are propagated through the resistor 78 and the diodes 84 and 85 to the gates of JFETs 92, 94 and 96, with a time constant of 2 ms or less, since the resistor 80 essentially is out of the circuit for such greater magnitude step load changes. Small perturbations (less than +/−0.5 V) are attenuated by the large value of resistor 80 and capacitor 82. The acrx signal is connected to the (+) input of amplifier 68. This amplifier is configured as a voltage follower with gain, and provides the demand level signal 32 (DLS), which is a low impedance output. The amplifier gain is set by the values of the resistors 70 and 72, which can be selected to meet specific DLS output requirements.

By providing the two different time constants through the filter circuit at the gates of the transistors 92, 94 and 96 with different RC combinations, the system is allowed to accommodate a slow response for steady state and slow variations in the DC load, as well as a fast response for step load changes using the VAR interface circuit. It is important to note that the DLS output on the terminal 32 is congruent with the rectified AC line voltage (ACR) and that there is very little phase shift between the signals, as illustrated in the idealized waveforms of FIG. 2. These characteristics are significant because the DLS output is the control reference for the PWM 30, which in turn regulates the AC line input current by controlling the on/off duty ratio of the transistor 24, as described previously in conjunction with FIG. 1.

Phase shift and waveform irregularities contribute to harmonic distortion and reduced power factor, as is well known. By utilizing the dynamic control response of the circuit of FIG. 4, a simple and accurate analog control circuit is provided for utilization in a power factor correction application.

Figure 5:
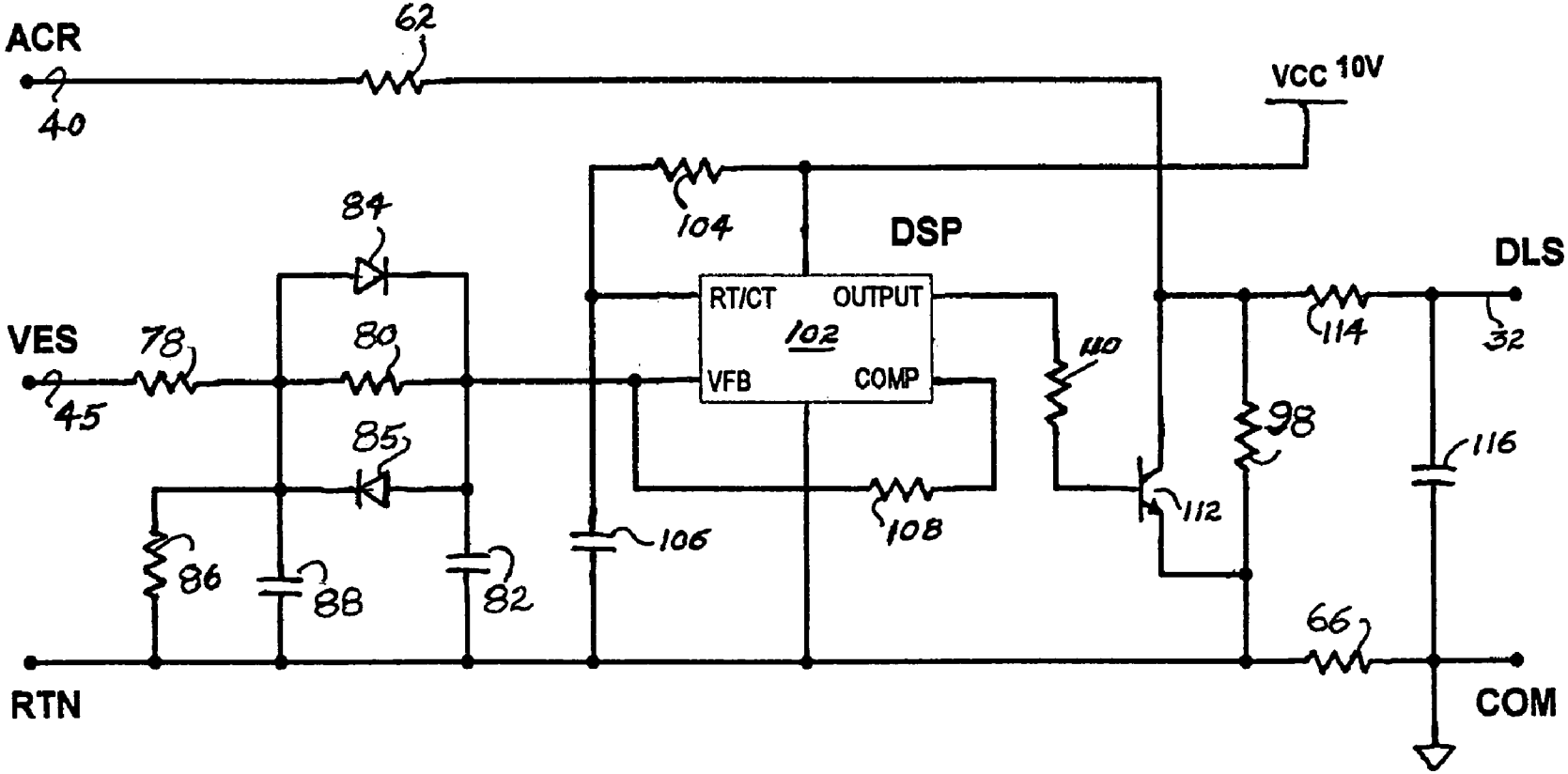
FIG. 5 is a detailed schematic diagram of another embodiment of the invention.

FIG. 5 illustrates another variation of the system employing a bi-polar transistor and a digital signal processing (DSP) circuit in place of the JFET devices 92,94 and 96 of FIG. 4 to perform the variable resistor function. The use of bi-polar transistors permits the implementation of a single adjustable duty ratio (DR) signal capable of controlling a single phase input or a two-phase or three-phase system. The control transistor is connected in parallel with a relatively large resistor and the transistor is switched on and off in varying amounts (varying duty cycle) to control the average resistance of the variable resistor consisting of the parallel-connected transistor and resistor. This implementation is effective for single-phase or multiple phase (such as three-phase) operation.

In FIG. 5, the ACR input 40 and the VES input 45 to the VAR circuit represented in FIG. 5 are the same as shown in FIG. 4. The same low pass filter circuit of FIG. 4, connected between the VES terminal 45 and the gates of the JFET devices also is employed in FIG. 5 between the VES terminal 45 and the input to a digital signal processor (DSP) circuit 102. This processor circuit essentially comprises a saw tooth generator and a comparator to provide a pulse width modulation of squarewave output pulses on the output terminal thereof. These output pulses are supplied through a coupling resistor 10 to the base of a bi-polar NPN transistor 112. A typical circuit which may be used for the DSP circuit 102 is a UNITRODE No. UCC3889. Other commercially available DSP circuits, however, could be used as well as the UNITRODE circuit to provide the same pulse width modulated output.

The output applied through the coupling resistor 110 to the transistor 112 has a proportional duty ration (DR) at a fixed frequency above the audible range. A filter comprising a resistor 104 and capacitor 106 is coupled between the VCC input to the DSP circuit 104 and the RC/CT input terminal. Another coupling resistor 108 connects the output of the low pass filter to the comparator input of the DSP circuit. The operation of the DSP circuit essentially converts the analog VES input at the output of the low pass filter into a digital signal with a varying duty cycle. This signal is used to switch on and off the transistor 112, the collector emitter path of which is connected in parallel with a relatively high value resistor 98 between the DLS output terminal 32 and the RTN line.

The output of the variable resistor comprising the transistor 112 and the fixed high value resistor 98 is filtered by another low pass filter comprising the resistor 114, capacitor 116, and resistor 66. This filter is used since there is a short delay between the DLS and ACR signals as a result of their low pass filter coupled to the VES terminal 45 required to attenuate the modulation switching frequency. Since the ACR and DLS signals are line frequency related (50/60 Hz), it is reasonable to use an RC averaging filter for a 62 KHz modulated signal.

For the circuit design and component selection of the circuit shown in FIG. 5, DLS (the signal appearing on terminal 32) is defined by the following equation:

$$DLS=[(R112)/(R112+R98)]\times(1-DR)\times ACR$$

The foregoing description of the preferred embodiment of the invention is to be considered as illustrative and not limiting. Various changes and modifications will occur to those skilled in the art for performing substantially the same function, in substantially the same way, to achieve substantially the same result, without departing from the true scope of the invention as defined in the appended claims.

What is claimed is:

1. A variable amplitude voltage regulator for use in a power factor correction system including in combination:

a resistor scaling network consisting of at least one variable resistor comprising at lease one bi-polar transistor having a base, an emitter, and a collector, the collector emitter path of which is connected in parallel with a fixed resistance;

a source of rectified alternating current input voltage (ACR) coupled to the resistor scaling network;

a voltage error differential amplifier coupled to the ACR and to a reference signal to produce a voltage error signal (VES);

a digital signal processing (DSP) circuit;

means coupling the VES to the DSP to produce an output signal at a predetermined frequency with an adjustable duty ratio (DR);

means coupling the ACR with the collector emitter path of the transistor and the output signal from the DSP to the base of the transistor to produce a demand level control signal which varies as a function of the VES dc level.

2. The variable amplitude voltage regulator according to claim 1 wherein the predetermined frequency of the output signal of the DSP is a fixed frequency above the audible range and the transistor is switched fully on and off in a ratio determined by the adjustable duty ratio (DR) of the output of the DSP.

3. The variable amplitude voltage regulator according to claim 2 wherein the demand level control signal (DLS) is defined by the following equation:

$$DLS=[(R1)/(R1+R2)\times(1-DR)\times ACR$$

where R1 is the resistance of the transistor and R2 is the resistance of the resistor connected in parallel with the collector emitter path of the transistor.

4. The variable amplitude voltage regulator according to claim 1 wherein the demand level control signal (DLS) is defined by the following equation:

$$DLS=[(R1)/(R1+R2)\times(1-DR)\times ACR$$

where R1 is the resistance of the transistor and R2 is the resistance of the resistor connected in parallel with the collector emitter path of the transistor.

* * * * *